United States Patent [19]

Russi

[11] 4,055,360

[45] Oct. 25, 1977

[54] SECURITY LOCK

[76] Inventor: Bartello C. Russi, 2925 Mendoza Drive, Costa Mesa, Calif. 96702

[21] Appl. No.: 678,908

[22] Filed: Apr. 21, 1976

[51] Int. Cl.[2] ..... E05C 3/14

[52] U.S. Cl. ..... 292/228; 49/56; 49/141; 292/181; 292/341.17

[58] Field of Search ..... 292/228, 263, 181, DIG. 72, 292/DIG. 14, 253, 341.17; 49/56, 67, 394, 141

[56] References Cited

U.S. PATENT DOCUMENTS

| | | | |
|---|---|---|---|
| 956,766 | 5/1910 | Humphrey et al. | 292/263 |
| 2,699,568 | 1/1955 | Herscher | 292/341.17 |
| 2,723,552 | 11/1955 | Dlugatch | 292/DIG. 14 |
| 3,843,176 | 10/1974 | Gonzalez-Cuzan | 292/218 |
| 3,921,334 | 11/1975 | Black, Sr. | 49/56 |

FOREIGN PATENT DOCUMENTS

| | | | |
|---|---|---|---|
| 374,576 | 1/1932 | United Kingdom | 49/56 |

*Primary Examiner*—Paul R. Gilliam
*Assistant Examiner*—Kenneth J. Dorner
*Attorney, Agent, or Firm*—Gordon L. Peterson

[57] ABSTRACT

A security lock comprising a tube having inner and outer ends and a passage extending between such ends, and a shaft including first and second shaft sections interconnected for pivotal movement relative to each other. The shaft has inner and outer end portions. The shaft has a first position in which it is received in the passage of the tube with the inner end portion of the shaft projecting beyond the inner end portion of the tube. A latch which includes the inner end portion of the shaft releasably locks the shaft in the first position so that upon release of the latch, the shaft can move toward the outer end of the tube.

2 Claims, 4 Drawing Figures

SECURITY LOCK

BACKGROUND OF THE INVENTION

Ornamental grilles are commonly used on buildings for aesthetic and/or security purposes. It is conventional practice to permanently attach an ornamental grille over a window. While this is desirable for security purposes, it eliminates that window as an escape route in the event of a fire or other emergency. Ornamental grilles affixed to the building in this manner, coupled with a fire which blocks other exit paths, have combined to imprison the occupants of a burning building.

Various releasable locking mechanisms have been used with ornamental grillework. However, none of these have been satisfactory for assuring quick and easy release of an ornamental grille from the interior of a building. One ornamental grille lock which is usable with a wrought iron gate, is shown in U.S. Pat. No. 3,843,176 which issued to Gonzalez-Cuzan. This patent shows a lock including a bar attached to the ornamental grille and extending part way into a rotatable barrel. The barrel is mounted in the fixed structure of the gate or wall and can be rotated to lock and release the locking mechanism.

While the patented construction may be suitable for gate usage, it is not adapted for use in releasably attaching ornamental grilles to buildings. For example, with the patented construction the locking and releasing action occurs within a barrel which is in turn embedded within the wall. As the locking mechanism is concealed and rigidly enclosed by the wall, it is not accessible. Accordingly, if the lock should jam or bind during an emergency, it could not be quickly repaired or released. In addition, the rotatable barrel, being embedded in the wall, is more subject to jamming due to dirt and other contaminants or due to movement of the wall which may be caused by settling of the building, earthquakes, expansion, contraction, etc.

SUMMARY OF THE INVENTION

The present invention solves the problems noted above by providing a security lock which is quickly and easily releasable from the interior of the building. The latching mechanism is entirely on the inside of the wall, i.e., within the building, and is readily accessible from the interior of the building. The latching mechanism is not subject to binding or failing to release.

The security lock of this invention can be used in various different environments. For example, a grille may be pivotally attached to the outside of a wall of a building and the security lock may be used to releasably lock the grille in the closed position. The security lock can advantageously include a shaft attached to the grille and projecting through an opening in the wall so as to expose an end portion of the shaft on the inside of the wall. A locking element is mounted on the inside of the wall and cooperates with the inner end portion of the shaft to lock the grille in the closed position.

The security lock may also advantageously include a tube having inner and outer ends and a passage extending between the ends thereof. The tube extends through the wall, and the shaft is receivable in the tube. To facilitate moving of the shaft out of the tube as is necessary to open the grille, the shaft is preferably jointed. This prevents the shaft from binding in the tube even if the wall of the building shifts after installation of the security lock. The space between the tube and the shaft is preferably sealed by a seal which may be carried by the outer end portion of the shaft.

It is desirable to affix the tube to the wall of the building. This can advantageously be accomplished by one or more mounting plates attached to the inner and outer surfaces of the wall with the end portions of the tube being received in corresponding apertures in the mounting plate. The mounting plates help keep the tube from shifting in the wall during use of the security lock and as the wall of the building shifts or moves.

The latching means for locking the shaft in a closed position can be of various different forms so long as it is readily accessible and is not likely to jam. For example, the latching means may include a locking member pivotally mounted on one of the mounting plates for movement toward and away from the inner end portion of the shaft, resilient means for urging the locking member toward the inner end portion of the shaft, and cooperating surfaces on the inner end portion and the locking member for retaining the shaft in a locked position.

Another feature of the latching means is that it is responsive to the shaft being in a predetermined position for automatically locking the shaft in such position. This can advantageously be accomplished by providing a cam surface on at least one of the locking members and the inner end portion of shaft. In addition, because the locking member is spring biased, an abutment is provided for preventing the locking member from pivoting to a position in which the cam would be ineffective to cam the locking member away from the shaft.

To facilitate and hasten opening of the grille upon release of the security lock, resilient means are provided for urging the grille toward an open position. Such resilient means can advantageously include a spring within the tube for urging the shaft toward the outer end of the tube.

The invention, together with further features and advantages thereof, may best be understood by reference to the following description taken in connection with the accompanying illustrative drawing.

DESCRIPTION OF THE PREFERRED EMBODIMENT

Figure 1:
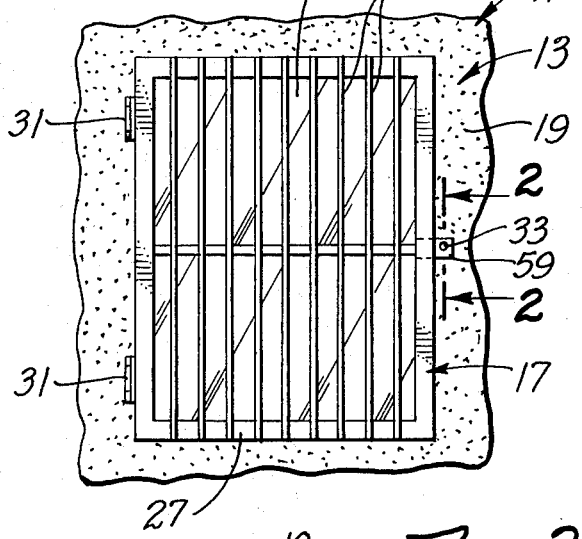
FIG. 1 is a fragmentary elevational view of an ornamental grille construction made in accordance with the teachings of this invention.

FIG. 1 shows an ornamental grille construction 11 which includes a wall 13 of a building such as a house, a window 15 mounted on the wall 11 in a conventional manner and an ornamental wrought iron grille 17. The wall 13 has an outer side 19 on the outside of the building and an inner side 21 (FIG. 2) on the inner side of the building. The wall 13 can be of any construction, and in the embodiment illustrated, it includes an outer panel 23 and an inner panel 25 (FIG. 2).

The grille 17 may be of various different constructions and the form shown in FIG. 1 is purely illustrative. The grille 17 includes a frame 27 and a plurality of spaced vertical bars 29 attached to the frame.

The grille 17 is mounted on the wall 13 by a pair of hinges 31 for pivotal movement about a generally vertical pivotal axis. A security lock 33 is spaced from the pivot axis defined by the hinges 31 to releasably retain the grille 17 in a closed position in which it confronts and is closely adjacent the outer side 19 of the wall 13.

Figure 2:
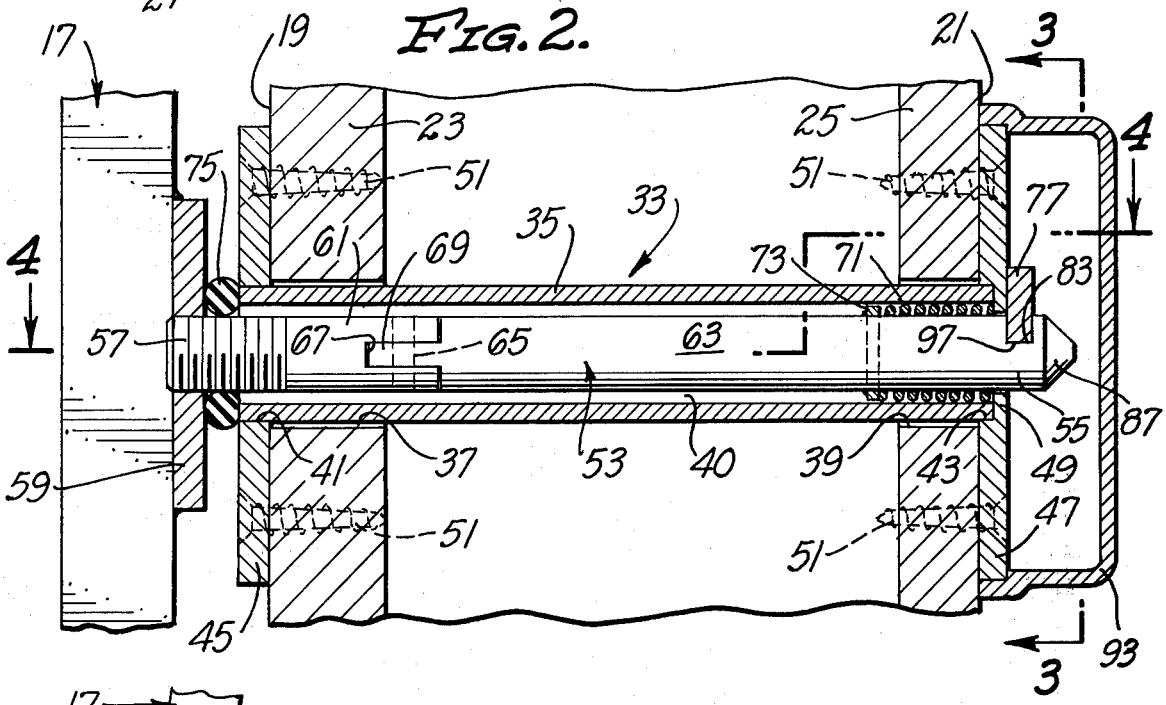
FIG. 2 is an enlarged fragmentary sectional view taken generally along lines 2—2 of FIG. 1 and showing a security lock constructed in accordance with the teachings of this invention.

As shown in FIG. 2, the security lock 33 includes a tube 35 of metal or strong plastic, the opposite ends of which extend through openings 37 and 39 in the panels 23 and 25, respectively. Thus, the tube 35 extends completely through the wall 13. The tube 35 has an axial cylindrical passage 40 which extends completely through the tube. The opposite ends of the tube 35 are received in apertures 41 and 43 formed in outer and inner mounting plates 45 and 47, respectively. Although various constructions are possible, in the embodiment illustrated, the outer end of the tube 35 is flush with the outer surface of the outer mounting plate 45. The mounting plate 47 has an annular shoulder 49 which projects into the aperture 43 and the inner end of the tube 35 abuts the shoulder 49. The tube 35 may be attached to the mounting plates 45 and 47 in various different ways such as by welding or a force fit. The mounting plates 45 and 47 are mounted on the outer panel 23 and the inner panel 25, respectively, in any suitable manner such as by a plurality of screws 51.

The lock 33 also includes a shaft 53 of metal or strong plastic of greater length than the tube 35. The shaft 53 is received within the passage 40 of the tube 35, and there is preferably a sizable radial clearance between the shaft and the passage. The shaft 53 has an inner end portion 55 and an outer end portion 57 both of which lie outside of the tube 35 in the locked position shown in FIG. 2. The outer end portion 57 is attached to a tab 59 in any suitable manner such as by screw threads and the tab is in turn affixed as by welding to the frame 27 of the grille 17 on the side of the grille opposite the hinges 31. This adapts the lock 33 for retrofit on existing grilles.

To facilitate insertion and withdrawal of the shaft 53 from the passage 40 of the tube 35 as the grille 17 pivots between open and closed positions, the shaft is preferably jointed. Although this can be accomplished in various different ways, in the embodiment illustrated, the shaft 53 includes an outer shaft section 61 and an inner shaft section 63 suitably pivotally interconnected as by a pin 65 for pivotal movement about a pivot axis which is generally parallel to the pivot axis defined by the hinges 31. Although this joint can be formed in different ways, in the embodiment illustrated, the outer shaft section 61 has a groove 67 which receives a tongue 69 on the inner shaft section 63, and the pin 65 extends through the groove and the tongue. The joint defined by the pin 65 is preferably located closer to the outer side 19 than the inner side 21 in the locked position shown in FIG. 2. This enables a minimum pivotal movement of the grille 17 toward the open position to free the joint from the confines of the tube 35.

A spring 71 within the passage 40 acts against the shoulder 49 and a retainer 73 affixed to the shaft 53 to urge the shaft axially outwardly; i.e., away from the inner side 21. An annular resilient seal 75 in the form of an "O" ring is mounted on the outer end portion 57 to seal the radial clearance between the shaft 53 and the tube 35.

Latching means is provided to retain the shaft 53 in the locked position shown in FIG. 2. The latching means can take different forms; however, the latching means is preferably located on the inner side 21 so that it is readily accessible from the interior of the building of which the wall 13 forms a part. In the embodiment illustrated, the latching means includes a locking member 77, a pin 79 (FIGS. 3 and 4) on the inner mounting plate 47 for mounting the locking member for pivotal movement toward and away from the inner end portion 55, a spring 81 for urging the locking member toward the inner end portion 55, and a groove 83 in the inner end portion 55 adapted to receive a portion of the locking member. More particularly, the pin 79 may be formed integrally with, or mounted on, the inner mounting plate 47. The spring 81 has one end affixed to the mounting plate 47 by a pin 85 and the outer end bears on the locking member 77. This urges the locking member 77 clockwise as viewed in FIG. 3 and resiliently holds a portion of the locking member in the groove 83.

Figure 3:
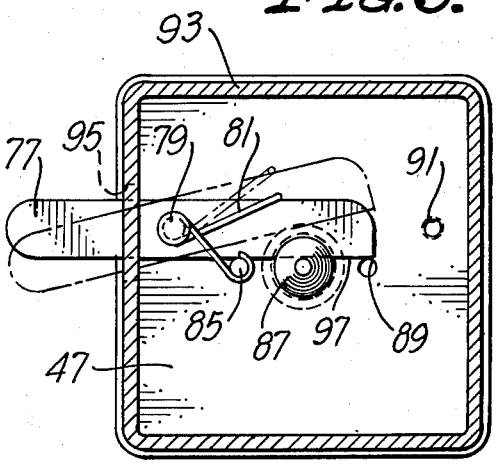
FIG. 3 is a sectional view taken generally along line 3—3 of FIG. 2.
Figure 4:
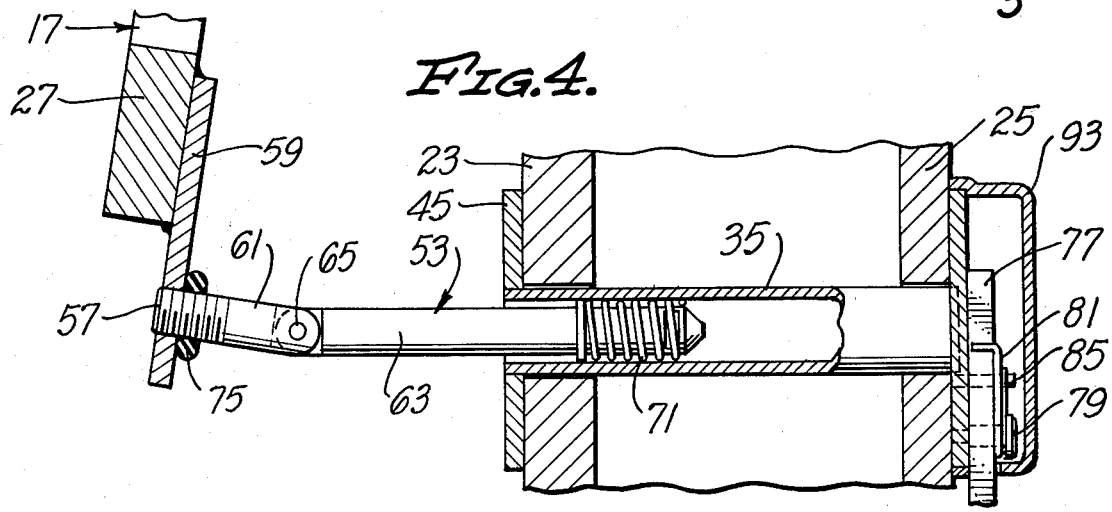
FIG. 4 is a sectional view taken generally along line 4—4 of FIG. 2 with the security lock being in a released position and with the grille being moved toward a fully open position.

To permit the latching means to automatically lock the shaft in the locking position shown in FIG. 2, the shaft 53 has a conical cam surface 87 and an abutment 89 prevents the locking member from pivoting clockwise, as viewed in FIG. 3, to a position in which the cam surface 87 is ineffective to cam the locking member 77 as the shaft 53 is moved axially inwardly toward the position shown in FIG. 2. A pin 91 is mounted on the inner mounting plate 47 so that the locking member 77 may be mounted thereon in lieu of the pin 79 if it is desired to have the locking member project in the other direction. In this event, the spring would be attached to the abutment 89, and the pin 85 would serve as the abutment.

If desired, the inner mounting plate 47 and a portion of the latching means can be covered with an easily removable cover 93. The cover 93 must be easily removed to provide direct access to the locking member 77 and the shaft 53. In the embodiment illustrated, the cover 93 forms a friction fit with the mounting plate 47. The cover 93 has a slot 95 through which a portion of the locking member 77 can project.

With the grille 17 and the lock 33 in the position shown in FIGS. 1–3, the grille covers, confronts, and is in close proximity to, the window 15, and the shaft 53 is received within the passage 40 of the tube 35. In addition, a portion of the locking member 77 is resiliently held in the groove 83 of the inner end portion 55 by the spring 81. To release the lock 33, the operator pivots the locking member 77 counterclockwise as viewed in FIG. 3 to remove the locking member from the groove 83 whereupon the spring 71 urges the shaft 53 axially to the left as viewed in FIG. 3 to the open position.

The pin 65 permits the shaft sections 61 and 63 to pivot relative to each other to prevent the shaft from binding with the tube 35 as the grille 17 is opened or closed. The spring biased locking member 77 and the cooperating groove 83 are of simple design and there is virtually no chance of jamming. The cover 93 is easily removable to provide direct access to the locking member 77 and the groove 83 for repair, maintenance, and emergency situations.

As soon as the shaft 53 clears the locking member 77, the spring 81 urges the locking member into engagement with the abutment 89. The abutment 89 is positioned so that a bottom edge 97 (FIG. 3) of the locking member 77 cannot move out of the path of the active portion of the cam surface 87. Accordingly, to relock the lock 33 in the position shown in FIG. 2, it is only necessary to pull the grille 17 inwardly to the position shown in FIG. 2. Locking is accomplished by the cam surface 87 engaging the bottom edge 97 of the locking member 77 and urging the same upwardly along the cam surface. When the shaft 53 has been moved far enough into the passage 40 of the tube 35, the spring 81 urges the locking member 77 into the groove 83 as shown in FIG. 2. Thus, locking is automatically achieved as a result of moving the grille and the shaft 53 to the closed position.

Although an exemplary embodiment of the invention has been shown and described, many changes, modifications, and substitutions may be made by those having ordinary skill in the art without necessarily departing from the spirit and scope of this invention.

I claim:

1. A security lock for a first member comprising:

a tube having inner and outer ends and a passage extending between said ends thereof;

a shaft including at least first and second shaft sections and attaching means for attaching said shaft sections together for pivotal movement relative to each other, said shaft having outer and inner end portions;

said shaft having a first position in which it is received in said passage of said tube with the inner end portion of the shaft projecting beyond the inner end of said tube and with the attaching means being within said passage of said tube, said outer end being attachable to the first member;

latching means including said inner end portion of said shaft for releasably locking the shaft in the first position whereby upon release of the latch means said shaft is released to move toward the outer end of the tube;

said latching means including a locking member, means for mounting the locking member for pivotal movement toward and away from said inner end portion of said shaft at least when said shaft is in said first position, resilient means for urging the locking member toward the inner end portion of the shaft at least when said shaft is in said first position, and cooperating surfaces on said inner end portion and said locking member for retaining said shaft in said first position;

cam means on at least one of said locking member and said inner end portion of said shaft responsive to movement of the shaft toward the first position to cam the locking member away from the shaft;

abutment means for preventing the locking member from pivoting to a position in which the cam means is ineffective to cam the locking member away from the shaft as the shaft moves toward the first position;

a mounting plate adjacent the inner end of the tube, said mounting plate having an aperture therein through which the inner end portion of the shaft can project, said locking member being pivotally mounted on said mounting plate and said abutment means being carried by the mounting plate;

a seal for sealing between the tube and the shaft; and resilient means in said tube for urging the shaft toward the outer end of the tube.

2. A security lock as defined in claim 1 wherein said shaft is longer than said tube and said outer end portion of said shaft projects beyond the outer end of said tube in said first position.

* * * * *